US008375729B2

(12) United States Patent
Schwartz et al.

(10) Patent No.: US 8,375,729 B2
(45) Date of Patent: Feb. 19, 2013

(54) OPTIMIZATION OF A THERMOACOUSTIC APPARATUS BASED ON OPERATING CONDITIONS AND SELECTED USER INPUT

(75) Inventors: David Eric Schwartz, Menlo Park, CA (US); Sean Garner, San Francisco, CA (US)

(73) Assignee: Palo Alto Research Center Incorporated, Palo Alto, CA (US)

( * ) Notice: Subject to any disclaimer, the term of this patent is extended or adjusted under 35 U.S.C. 154(b) by 233 days.

(21) Appl. No.: 12/771,666

(22) Filed: Apr. 30, 2010

(65) Prior Publication Data

US 2011/0265505 A1 Nov. 3, 2011

(51) Int. Cl.
*F25B 9/00* (2006.01)
*F25B 1/00* (2006.01)
*F25B 23/00* (2006.01)

(52) U.S. Cl. ..... 62/6; 62/215; 62/467

(58) Field of Classification Search ..... 62/6, 208, 62/211

See application file for complete search history.

(56) References Cited

U.S. PATENT DOCUMENTS

| | | | |
|---|---|---|---|
| 3,548,589 | A | 12/1970 | Cooke et al. |
| 4,114,380 | A | 9/1978 | Ceperley |
| 4,355,517 | A | 10/1982 | Ceperley |
| 4,389,849 | A | 6/1983 | Gasser et al. |
| 4,398,398 | A | 8/1983 | Wheatley et al. |
| 4,489,553 | A | 12/1984 | Wheatley et al. |
| 4,534,176 | A | 8/1985 | Horn et al. |
| 4,686,407 | A | 8/1987 | Ceperley |
| 5,167,124 | A | 12/1992 | Lucas |
| 5,303,555 | A | 4/1994 | Chrysler et al. |
| 5,329,768 | A | 7/1994 | Moscrip |
| 5,357,757 | A | 10/1994 | Lucas |
| 5,369,625 | A | 11/1994 | Gabrielson |
| 5,647,216 | A | 7/1997 | Garrett |
| 5,673,561 | A | 10/1997 | Moss |
| 6,314,740 | B1 | 11/2001 | De Blok et al. |
| 6,385,972 | B1 | 5/2002 | Fellows |
| 6,560,970 | B1 | 5/2003 | Swift |
| 6,571,552 | B2 | 6/2003 | Ban et al. |
| 6,574,968 | B1 | 6/2003 | Symko et al. |
| 6,578,364 | B2 | 6/2003 | Corey |

(Continued)

FOREIGN PATENT DOCUMENTS

| | | |
|---|---|---|
| GB | 1252258 | 11/1971 |
| WO | 2005/001269 A1 | 1/2005 |

(Continued)

OTHER PUBLICATIONS

Spoelstra, S. et al., "ThermoAcoustic Technology for Energy Applications", Interim Activity Report, FP7-Energy-2008-FET, European Commission within the Seventh Framework Programme (2007-2013), Feb. 10, 2010.

(Continued)

*Primary Examiner* — Frantz Jules
*Assistant Examiner* — Keith Raymond
(74) *Attorney, Agent, or Firm* — Jonathan A. Small

(57) ABSTRACT

In a thermoacoustic refrigerator, operating temperatures, ambient temperature, and selected user input are utilized to control frequency and/or input power in order to optimize the efficiency of the thermoacoustic refrigerator operation. In a thermoacoustic heat engine, operating temperatures, ambient temperature, and selected user input are utilized to control impedance of a load to optimize the efficiency of the thermoacoustic heat engine operation.

6 Claims, 9 Drawing Sheets

U.S. PATENT DOCUMENTS

| | | | | |
|---|---|---|---|---|
| 6,591,610 | B2 | 7/2003 | Yazawa et al. | |
| 6,604,364 | B1 | 8/2003 | Arman et al. | |
| 6,644,028 | B1 | 11/2003 | Swift et al. | |
| 6,658,862 | B2 | 12/2003 | Swift et al. | |
| 6,688,112 | B2 | 2/2004 | Raspet et al. | |
| 6,711,905 | B2 | 3/2004 | Howard | |
| 6,725,670 | B2 | 4/2004 | Smith et al. | |
| 6,732,515 | B1 | 5/2004 | Weiland et al. | |
| 6,792,764 | B2 | 9/2004 | Poese et al. | |
| 6,804,967 | B2 | 10/2004 | Symko et al. | |
| 6,868,673 | B2 | 3/2005 | Weiland et al. | |
| 6,910,332 | B2 | 6/2005 | Fellows | |
| 6,910,335 | B2 | 6/2005 | Viteri et al. | |
| 7,017,351 | B2 | 3/2006 | Hao et al. | |
| 7,055,332 | B2 | 6/2006 | Poese et al. | |
| 7,062,921 | B2 | 6/2006 | Jeng et al. | |
| 7,081,699 | B2 | 7/2006 | Keolian et al. | |
| 7,143,586 | B2 | 12/2006 | Smith et al. | |
| 7,156,487 | B2 | 1/2007 | Chou et al. | |
| 7,228,694 | B2 * | 6/2007 | Schwarz et al. | 62/228.4 |
| 7,240,495 | B2 | 7/2007 | Symko et al. | |
| 7,263,837 | B2 | 9/2007 | Smith | |
| 7,290,771 | B2 | 11/2007 | Smith | |
| 7,434,409 | B2 | 10/2008 | Gedeon | |
| 2003/0192323 | A1 | 10/2003 | Poese et al. | |
| 2003/0192324 | A1 * | 10/2003 | Smith et al. | 62/6 |
| 2003/0226364 | A1 | 12/2003 | Swift et al. | |
| 2006/0266041 | A1 | 11/2006 | Fellows | |
| 2006/0266052 | A1 | 11/2006 | Hsing et al. | |
| 2007/0261839 | A1 | 11/2007 | Watanabe et al. | |
| 2008/0060364 | A1 | 3/2008 | Watanabe et al. | |
| 2010/0132934 | A1 * | 6/2010 | Storm et al. | 166/57 |

FOREIGN PATENT DOCUMENTS

| | | | |
|---|---|---|---|
| WO | 2005022606 | A2 | 3/2005 |
| WO | 2008036920 | A2 | 3/2008 |
| WO | WO 2008036920 | A2 * | 3/2008 |
| WO | 2009124132 | A1 | 10/2009 |
| WO | 2010/107308 | A1 | 9/2010 |

OTHER PUBLICATIONS

Radebaugh, R., "Development of the Pulse Tube Refrigerator as an Efficient and Reliable Cryocooler", Proc. Inst. of Refrigeration (London 1999-2000).

Rossing, T. D. (Ed.), "Springer Handbook of Acoustics", Ch. 7, pp. 239-255 (Springer 2007).

Physorg.com, "A sound way to turn heat into electricity", 3 pages (Jun. 4, 2007).

Swift, G.W., et al., "Acoustic recovery of lost power in pulse tube refrigerators", J. Accoust. Soc. Am. (2), pt. 1, pp. 711-724 (Feb. 1999).

de Blok, K., "4-stage thermo acoustic power generator", Aster Thermoakoestische Systemen, FACT Foundation,Jul. 12, 2010.

* cited by examiner

OPTIMIZATION OF A THERMOACOUSTIC APPARATUS BASED ON OPERATING CONDITIONS AND SELECTED USER INPUT

CROSS-REFERENCE TO RELATED APPLICATIONS

The present disclosure is related to U.S. patent application titled "Thermoacoustic Apparatus With Series-Connected Stages", Ser. No. 12/771,617, assigned to the same assignee as the present application, and further which, in its entirety, is hereby incorporated herein by reference.

BACKGROUND

The present disclosure is related to thermoacoustic devices, and more specifically to an electrical control system for optimizing the operation of a thermoacoustic device such as a thermoacoustic refrigerator or thermoacoustic heat engine.

The pulse-tube refrigerator, an example of which is shown in FIG. 8, typifies travelling-wave thermoacoustic refrigerators. In device 10, an acoustic wave travels through a gas. The pressure and velocity oscillations of the gas are largely in-phase in certain regions of the device. Thus, these devices are generally referred to as traveling-wave devices. See, for example, U.S. patent application Ser. No. 12/533,839 and U.S. patent application Ser. No. 12/533,874, each of which being incorporated herein by reference.

In device 10, an acoustic source 12, for example an electromechanical transducer with a moving piston, generates oscillating acoustic energy in a sealed enclosure 14 containing compressed gas. Noble gases, such as helium, are often used, though many gases and combinations thereof, including air, can be utilized. The acoustic energy passes through a first heat exchanger, the "hot" heat exchanger 16, generally connected, for example via heat exchange fluid, to a heat reservoir at ambient temperature, a regenerative heat exchanger, or "regenerator" 18 (described below), and another heat exchanger, the "cold" heat exchanger 20, which is connected, for example via heat exchange fluid, to the thermal load which is to be cooled by the refrigerator. Usually, the cold heat exchanger is followed by another tube, called a "pulse tube," 22 and a last ambient-temperature heat exchanger, the "ambient" heat exchanger 24, which serves to isolate the cold heat exchanger and thereby reduce parasitic heat loading of the refrigerator. The "hot" heat exchanger 16 and "ambient" heat exchanger 24 are often at the same temperature. After the "ambient" heat exchanger is an acoustic load 26, often an orifice in combination with inertances and compliances, which dissipates acoustic energy. Here, a "heat exchanger" is taken to mean a device which exchanges heat between a gas inside the thermoacoustic device and an outside fluid, such as a stream of air.

In steady state, a temperature gradient is established in the regenerator in the direction from the hot to the cold heat exchanger (if taken as a vector the gradient would be in the opposite direction). Heat is ideally transferred nearly isothermally between the gas and the regenerator material, often metal or ceramic porous material or mesh. With traveling-wave acoustic phasing, the gas in the regenerator undergoes an approximate Stirling cycle. In this way, the maximum heat can be moved from the cold to the hot heat exchanger per acoustic energy consumed.

FIG. 9 illustrates a looped travelling-wave thermoacoustic refrigerator device 30 of a type known in the art. In device 30, acoustic load (26 of FIG. 8) is replaced by an acoustic section

46 that delivers part of the acoustic energy that would otherwise be dissipated in the load to the back face of the electromechanical transducer 32, thereby reducing the electrical input power required for a given cooling power and therefore increasing the efficiency of the device. In another configuration disclosed in the aforementioned U.S. patent application titled "Thermoacoustic Apparatus With Series-Connected Stages", Ser. No. 12/771,617, "excess" acoustic power is delivered to the back of an electromechanical transducer of a second thermoacoustic refrigerator, whose load is similarly replaced with an acoustic section that delivers its "excess" acoustic power to the back face of the first electromechanical driver in a closed loop. Similarly, three or more thermoacoustic refrigerator units can be connected, output-to-input, in a closed loop. In another device known in the art, the "excess" acoustic power is delivered to the front face of the electromechanical transducer.

Analogously, a traveling-wave thermoacoustic heat engine is a device which converts heat to work. FIG. 10 illustrates an embodiment 50 of such a device known in the art. In this device, heat is applied at "hot" heat exchanger 54, which is maintained at a high temperature. "Cold" heat exchanger 58 and "ambient" heat exchanger 62 are maintained at ambient or cold temperatures. Oscillating acoustic energy in the enclosure 52 is converted to electrical energy by a power transducer 66, for example, an electromagnetic transducer.

The temperatures in thermoacoustic coolers and heat engines are rarely fixed, but are functions of ambient conditions, heat availability, user settings, and so forth. When operated at a given power and frequency, the efficiencies of thermoacoustic refrigerators vary with the temperatures of the hot, cold, and ambient heat exchangers. Similarly, when operated at a given power and with a given load, the efficiencies of thermoacoustic heat engines vary with the temperatures of the heat exchangers. This effect is particularly significant in the case of a looped refrigerator (as in FIG. 9) or engine (as in FIG. 10) because such a system is resonant, with the resonant frequency depending in part on the operating temperatures, such as the temperatures of the ambient environment in which the device operates, the temperatures of the several heat exchangers, and so on, which affect the acoustic gain inside the regenerator, and, in the case of the engine, the load. As the temperatures change, the resonant frequency changes and hence the optimal frequency of operation changes. In the case of a pulse-tube refrigerator and like devices, as the temperatures change, the phasing of the acoustic power in the region of the regenerator changes, potentially reducing the effectiveness of heat regeneration and thereby the efficiency of the device. Therefore, there is needed in the art an apparatus and method for controlling aspects of the operation of a thermoacoustic device so as to optimize its efficiency as a function of the conditions of operation, such as temperature, humidity, etc.

SUMMARY

Accordingly, the present disclosure is directed to a system and method for providing electrical control of the frequency and/or input power of a thermoacoustic refrigerator to optimize its efficiency as a function of operating temperatures, the ambient temperatures, humidity, and selected user input. It is also directed to a system and method for providing electrical control of the impedance of the load of a thermoacoustic heat engine to optimize its efficiency as a function of operating temperatures, the ambient temperature, humidity, and selected user input.

A thermoacoustic refrigerator includes a generally hollow, sealed body containing a working gas. Within said body is disposed: a regenerator, a first heat exchanger, a second heat exchanger, and an electromechanical driver. Acoustic energy from the electromechanical driver is directed into the body. Each heat exchanger may be provided with temperature sensors for measuring the temperature proximate the heat exchanger internal to the body and/or external to the body and/or of the heat exchange fluid, if present, during operation of the thermoacoustic apparatus. Ambient temperature sensors may also be provided for measuring the temperature in the ambient region of the device, to which heat is rejected. Additional temperature sensors may be provided for measuring the temperature of the space being cooled. Humidity sensors may also be provided for measuring the relative or absolute humidity in the ambient region to which heat is rejected and/or the space being cooled. A controller receives data from the various sensors, typically measured at a plurality of times, and determines and provides a control signal based on these signals and on user input. The control signal is provided to a variable frequency driver, which drives the electromechanical driver according to the control signal. In this way, the operation of the thermoacoustic apparatus is controlled, at least in part, as a function of the heat exchanger temperatures, ambient temperature, and ambient humidity. Operation of the thermoacoustic apparatus may then be optimized (e.g., driving power requirement minimized) in use.

Furthermore, acoustic power within the body may be converted to electrical energy, and the state of this conversion may also be factored into the control signal. In addition, transducers measuring the acoustic pressure and gas flow velocity may be disposed inside the body and the outputs of these sensors may be factored into the control signal. In some embodiments, the past state of the system may be incorporated into the control algorithm. For example, whether a certain temperature signal is increasing or decreasing may be factored into the control signal as an additional input.

The controller may, in certain embodiments, be memory containing a look-up table in which independent variables, such as ambient temperature and humidity, as well as user defined operating parameters, such as the cold temperature set point and other operating parameters are matched to frequency and drive current such that the control signal is determined from the look-up table. In other embodiments, dependent variables, such as heat exchanger temperatures, internal pressures, and internal gas flow rates, and/or the past state of any independent or dependent variables may also be referenced in the look-up table to determine the control signal. In yet other embodiments, logic or digital or analog circuitry, or a combination of any of these elements, with or without look-up tables, may be used to determine the operating parameters, including the drive frequency and power. This logic may contain such functionality as switching among several look-up tables with different combinations of input variables depending on the current and past state of the device.

In embodiments with multiple acoustic transducers, the controller may determine an independent drive power and electrical phase for each transducer.

Operation of a thermoacoustic heat engine is essentially as described above, but without the electromechanical driver. Rather, an acoustic energy converter is provided within the body. The impedance of a load connected to the acoustic energy converter controls in part the operating state of the thermoacoustic heat engine. The control signal (determined at least in part from the various operating temperatures) determines the impedance of the load, thereby controlling the efficiency of operation of the thermoacoustic heat engine.

The above is a summary of a number of the unique aspects, features, and advantages of the present disclosure. However, this summary is not exhaustive. Thus, these and other aspects, features, and advantages of the present disclosure will become more apparent from the following detailed description and the appended drawings, when considered in light of the claims provided herein.

BRIEF DESCRIPTION OF THE DRAWINGS

In the drawings appended hereto like reference numerals denote like elements between the various drawings. While illustrative, the drawings are not drawn to scale. In the drawings.

DETAILED DESCRIPTION

We initially point out that descriptions of well known starting materials, processing techniques, components, equipment and other well known details are merely summarized or are omitted so as not to unnecessarily obscure the details of the present invention. Thus, where details are otherwise well known, we leave it to the application of the present invention to suggest or dictate choices relating to those details.

Figure 1:
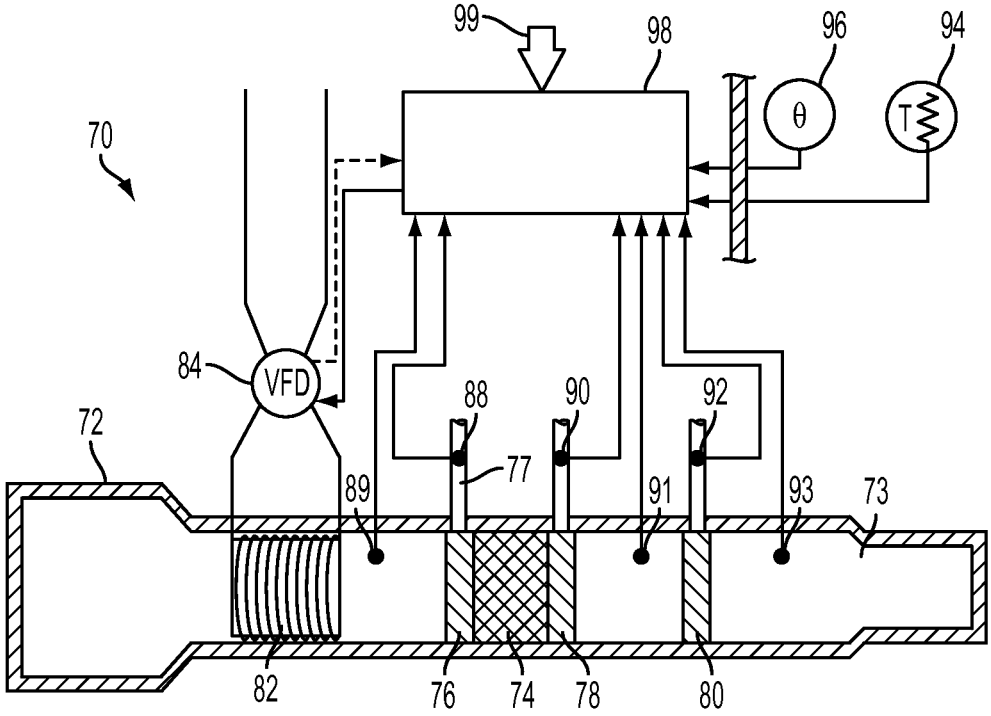
FIG. 1 is a cut-away illustration of a thermoacoustic refrigerator including control circuitry for optimizing efficiency as a function of operating temperatures, ambient temperature and humidity, and selected user input according to a first embodiment of the present disclosure.

FIG. 1 is a cut-away illustration of a first embodiment of a thermoacoustic refrigerator 70 including control circuitry for optimizing efficiency as a function of operating temperatures, the ambient temperature and humidity, and selected user input. While FIG. 1 and the description associated therewith are focused on a refrigerator, it will be appreciated that the discussions herein apply equally to heat pumps, heat engines and other forms of thermoacoustic devices, particularly as described further herein.

Thermoacoustic refrigerator 70 comprises a generally tubular body 72. The material from which body 72 is constructed may vary depending upon the application of the present invention. However, body 72 (and indeed all bodies described herein) should generally be thermally and acoustically insulative, and capable of withstanding pressurization to at least several atmospheres. Exemplary materials for body 72 include stainless steel or an iron-nickel-chromium alloy.

Disposed within body 72 is regenerator 74. Regenerator 74 (indeed, all regenerators described herein) may be constructed of any of a wide variety of materials and structural arrangements which provide a relatively high thermal mass and high surface area of interaction with the gas but low acoustic attenuation. A wire mesh or screen, open-cell material, random fiber mesh or screen, or other material and arrangement as will be understood by one skilled in the art may be employed. The density of the material comprising regenerator 74 may be constant, or may vary along its longitudinal axis such that the area of interaction between the gas and wall, and the acoustic impedance, across the longitudinal dimension of regenerator 74 may be tailored for optimal efficiency. Details of regenerator design are otherwise known in the art and are therefore not further discussed herein.

Adjacent each lateral end of regenerator 74 are first and second heat exchangers 76, 78, respectively. Heat exchangers 76, 78 (indeed, all heat exchangers described herein) may be constructed of any of a wide variety of materials and structural arrangements which provide a relatively high efficiency of heat transfer from within body 72 to a transfer medium. In one embodiment, heat exchangers 76, 78 may be one or more tubes for carrying therein a fluid to be heated or cooled. Heat exchangers 76, 78 are formed of a material and sized and positioned to efficiently transfer thermal energy (heating or cooling) between the fluid therein and the gas within body 72 during operation of the refrigerator. To enhance heat transfer, the surface area of heat exchangers 76, 78 may be increased with fins or other structures as is well known in the art. Tubes 77, 79 connected to heat exchangers 76, 78, respectively, permit the transfer of fluid from a thermal reservoir or load external to refrigerator 70 to and from heat exchangers 76, 78. Details of heat exchanger design are otherwise known in the art and are therefore not further discussed herein.

Optionally, a third heat exchanger 80 may be disposed within one end of body 72, for example such that heat exchanger 78 is located between third heat exchanger 80 and regenerator 74. Third heat exchanger 80 may be of a similar construction to first and second heat exchangers 76, 78 such as one or more tubes formed of a material and sized and positioned to efficiently transfer thermal energy (heating or cooling) between a fluid therein and the gas within body 72 during operation of the refrigerator. Tube 81 permits the transfer of fluid from a thermal reservoir or load external to refrigerator 70 to and from the third heat exchanger 80.

An electromechanical driver 82 (for example an acoustic wave source) is disposed within body 72, proximate first heat exchanger 76. Many different types of devices may serve the function of electromechanical driver 82, such as well-known moving coil, piezo-electric, electro-static, ribbon or other forms of loudspeaker. A very efficient, frequency tunable, and frequency stable speaker design is preferred so that the cooling efficiency of the refrigerator may be maximized.

A variable frequency driver (VFD) 84 is connected to electromechanical driver 82. VFD 84 is capable of driving electromechanical driver 82 at a desired frequency and amplitude with very high conversion efficiency. An acoustic load 73, such as an orifice, forms a part of body 72 proximate second or third heat exchangers 78, 80, which dissipates acoustic energy.

Initially, a gas, such as helium, is sealed within housing 72. Oscillating electric power from VFD 84 is provided to electromechanical driver 82 which generates acoustic oscillations in the gas. With proper choice of the dimensions and material choices for housing 72 and regenerator 74, and use of an appropriate gas, an approximate Stirling cycle is thus initiated in the region of regenerator 74, establishing a temperature gradient in regenerator 74 such that when the system reaches steady-state, first heat exchanger 76, the "hot" heat exchanger, is at relatively higher temperatures than second heat exchanger 78, the "cold" heat exchanger.

A Stirling cycle comprises a constant-volume cooling of the gas as it moves in the direction from the hot heat exchanger to the cold heat exchanger, rejecting heat to the regenerator, isothermal expansion of the gas, constant-volume heating of the gas as it moves in the direction from the cold heat exchanger to the hot heat exchanger, accepting heat from the regenerator, and consequent isothermal contraction of the gas, at which point the gas is at its initial state and the process repeats itself. In this way heat is moved from the cold to the hot heat exchangers. Regenerator 74 serves to store heat energy and greatly improve the efficiency of energy conversion.

In order to take into account the various system and ambient temperatures in determining the frequency and/or amplitude at which VFD 84 drives electromechanical driver 82, a number of sensors are employed. These can be generally divided into two types; those that sense quantities largely independent of the operating state of the device, such as ambient temperature and humidity, and those that sense quantities that are somewhat or largely dependent on the operating state of the device, such as internal pressure amplitude, gas flow rate, gas temperatures, and heat exchanger temperatures, and the temperature of the space being cooled.

According to the embodiment shown in FIG. 1, these sensors take the form of thermocouples, such as thermocouple 89 for measuring the temperature inside body 72 proximate heat exchanger 76, thermocouple 88 for measuring the temperature of the heat exchange fluid within heat exchanger 76, thermocouple 91 for measuring the temperature inside body 72 proximate heat exchanger 78, thermocouple 90 for measuring the temperature of the heat exchange fluid within heat exchanger 78, thermocouple 93 for measuring the temperature inside body 72 proximate heat exchanger 80, and thermocouple 92 for measuring the temperature of the heat exchange fluid within heat exchanger 80. The use of thermocouples as temperature sensors is only illustrative; any type temperature sensor may be utilized. In addition, an ambient temperature sensor 94 such as a thermocouple, a thermometer, etc. is disposed proximate body 72 for measuring, for example the ambient temperature in the space to which heat is rejected by the refrigerator, in the space proximate an intake of the apparatus, the outside temperature, etc. That is, this space may be physically proximate thermoacoustic refrigerator 70 or physically remote from thermoacoustic refrigerator 70, such as outside of the building being cooled or in an adjacent room (in the case of thermoacoustic refrigerator 70 being a room cooler). Thus, in one embodiment temperature sensor 94 is proximate thermoacoustic refrigerator 70, in another it is for example in the room being cooled but not necessarily proximate thermoacoustic refrigerator 70, and in still another embodiment temperature sensor 94 need not be anywhere near thermoacoustic refrigerator 70. We make the distinction here between the ambient temperature and the temperature inside the space being cooled. The latter is dependent on the operation of the device (i.e., the device is cooling it) while the former isn't. In concept, the operation of thermoacoustic refrigerator 70 can therefore be in part a function of the "outside" temperature, and not just the temperature of the room being cooled.

Furthermore, a hygrometer (humidity sensor) 96 may be disposed proximate body 72 for measuring the ambient humidity in the space to which heat is rejected by the refrigerator. Hygrometer 96, or additional hygrometers may also be located to measure the ambient absolute or relative humidity, as described above with regard to temperature sensor 94. It should be noted that while various thermocouples, a thermometer, and a hygrometer have been disclosed and shown in FIG. 1, many of these elements are optional, and we suggest that the minimum embodiment comprise a single thermometer, thermocouple, or similar sensor 89. That single thermometer, thermocouple, or similar sensor can measure temperature at a region of body 72, outside of the thermoacoustic device and in an area in which said thermoacoustic apparatus operates, at one of the heat exchangers, etc. Furthermore, additional thermocouples, thermometers, humidity sensors, and other sensors such as pressure and flow sensors, etc. may be provided, in various combinations, without departing the spirit and scope of the present disclosure.

Each of thermocouples 86, 88, 90, and 92, thermometer 94, and hygrometer 96 (as well as other sensor devices) are connected to provide data signals to a controller 98. Controller 98 uses the various temperature, humidity, and other measurements to generate a control signal for controlling VFD 84, which controls (varies) the frequency and input power, current, and/or voltage of the electromechanical driver 82 to optimize efficiency or cooling power. Controller 98 may sample the various variables periodically during operation of thermoacoustic refrigerator 70 and may provide periodic updated control signals to VFD 84 to account for changes in operating and ambient conditions and thereby maintain an optimal or selected efficiency. Thus, controller 98 can generate control signals at least in part from a plurality of temperature data signals, the signal taken at various times during operation of the thermoacoustic refrigerator 70, such that operation of the electromechanical driver 82 based on the control signals provides optimized operational efficiency for said thermoacoustic refrigerator 70. Alternatively, other mechanisms may be provided such that the temperatures from thermocouples 86, 88, 90, and 92, thermometer 94, and hygrometer 96 (as well as other sensor devices) are provided to controller 98 at intervals during operation of thermoacoustic refrigerator 70.

An additional input to controller 98 may be adjustable user parameters 99. Such user input parameters may include desired cooling power, maximum power consumption, desired cooling temperature, and so on for thermoacoustic refrigerator 70.

According to one embodiment, controller 98 comprises logic that is programmed to vary the frequency and/or power of electromechanical transducer 82 according to a lookup table containing a mapping from ambient temperature to frequency and power. For example, the power can be left fixed and the frequency can be made to increase as the ambient temperature increases. In one specific example that has been modeled, when the temperature at cold heat exchanger 78 (as measured by thermocouple 90) is 299.8 K and the temperatures of hot and ambient heat exchangers 76, 80 (as measured by thermocouples 88, 92, respectively) are both 308.2 K, the optimal frequency for 12.9 watts of input power was found to be 60 Hz. However, when the temperatures at hot and ambient heat exchangers 76, 80 increase to 318.2 K, the optimal frequency for 12.9 watts of input power increases to 61.2 Hz. Maintaining power requires increasing the input current from VFD 84 from 1.14 amps to 1.18 amps. Elements of a lookup table corresponding to this map are shown in table 1.

TABLE 1

| T at "hot" exchanger (K) | T at "cold" exchanger (K) | T at "ambient" exchanger (K) | . . . (additional parameters) | Drive current (amps) | Drive frequency (Hz) |
|---|---|---|---|---|---|
| | | . . . | | | |
| 308.2 | 299.8 | 308.2 | . . . | 1.14 | 60 |
| 318.2 | 299.8 | 318.2 | . . . | 1.18 | 61.2 |
| | | . . . | | | |

In one embodiment, the controller can be implemented with an embedded microprocessor and analog-to-digital and digital-to-analog converters. In another embodiment a fully analog solution consisting of a VFD and combinations of transistor amplifiers and other electronic components can be used. In yet another embodiment, a combination of analog and digital logic can be used. As is well known to those skilled in the art of control system design, feedback control systems, i.e., control systems using input variables dependent on the operating state of the device, and control systems with memory of the past state of the system, may achieve steady state operation only under certain conditions. Under other conditions, they may oscillate among different states, or fail to "capture" or "lock" into the desired state. Accordingly, in embodiments in which the controller of the system described herein uses dependent or historical variables as inputs, logic and control more involved than a look-up table may be required to assure steady state operation. For example, if the initial state of the system is beyond the capture range of the device, the control system may be designed to switch from utilizing solely independent variables to a combination of independent and dependent variables as the system nears its user-defined set point.

As a further example, some variables, such as pressure amplitude, respond relatively quickly to changing of operating parameters, while others, such as the temperature of the space being cooled, respond to changing operating parameters with a relatively long time lag. To prevent oscillations, the controller should respond to changes in the temperature of the space being cooled more slowly than to the changes in the pressure amplitude.

As a yet further example, consider a device with the look-up table in Table 1. This look-up table may not have entries for every combination of heat exchanger temperatures. In such a case, the controller might have logic which would turn the refrigerator on at a certain default frequency and power until the temperatures reached a set in the look-up table, at which time the device would be set to be "locked" and the controller would begin to use the look-up table to define the operating parameters.

In general, the techniques for designing such controllers are well-known to those skilled in the art of feedback control system design.

The optimal frequencies and powers will differ from thermoacoustic device to thermoacoustic device. They will also differ depending on user preferences, such as cooling power.

In one embodiment, controller 98 is designed for a specific thermoacoustic device (e.g., specific dimensions, materials, etc.) In another embodiment, controller 98 is configurable for use with multiple devices. For example, the lookup table can be stored in rewritable memory such as flash memory, and reprogrammed for each device. The lookup table need not be fixed for a given unit, but can be changed if the unit is moved to a different room, different conditions, etc. In various other embodiment, controllers can be interchangeable among devices of the same type (e.g., same cooling power), the controllers can be interchangeable among devices of different types (e.g., a 1 kW unit and a 10 kW unit), and/or an existing device can be retrofitted with sensors and a controller.

In another embodiment, controller 98 uses a feedback loop to optimize the efficiency and or power. Some sensed parameters, such as the outside temperature and humidity and the user settings, including the temperature set point, are independent of the controller output. Others, such as the internal temperatures of heat exchangers 76, 78, 80, the internal pressures, and the flow velocity, will vary as the frequency and power of VFD 84 are changed. Thus, in a feedback embodiment, additional sensors such as pressure and flow velocity sensors (not shown) located within body 72, and a measure of the state of VFD 84 (shown by the dashed line connecting VFD 84 and controller 98) are employed. A "feedback" system utilizes these latter values. A "feedforward" system only utilizes the former.

The feedforward system will be universally stable while the feedback system may not. Accordingly, the control system with feedback may imply a more complex process. For example, in one embodiment the system starts up using only feedforward-type (i.e., independent) inputs. Once the system reaches steady-state, the system then implements the feedback system.

Figure 2:
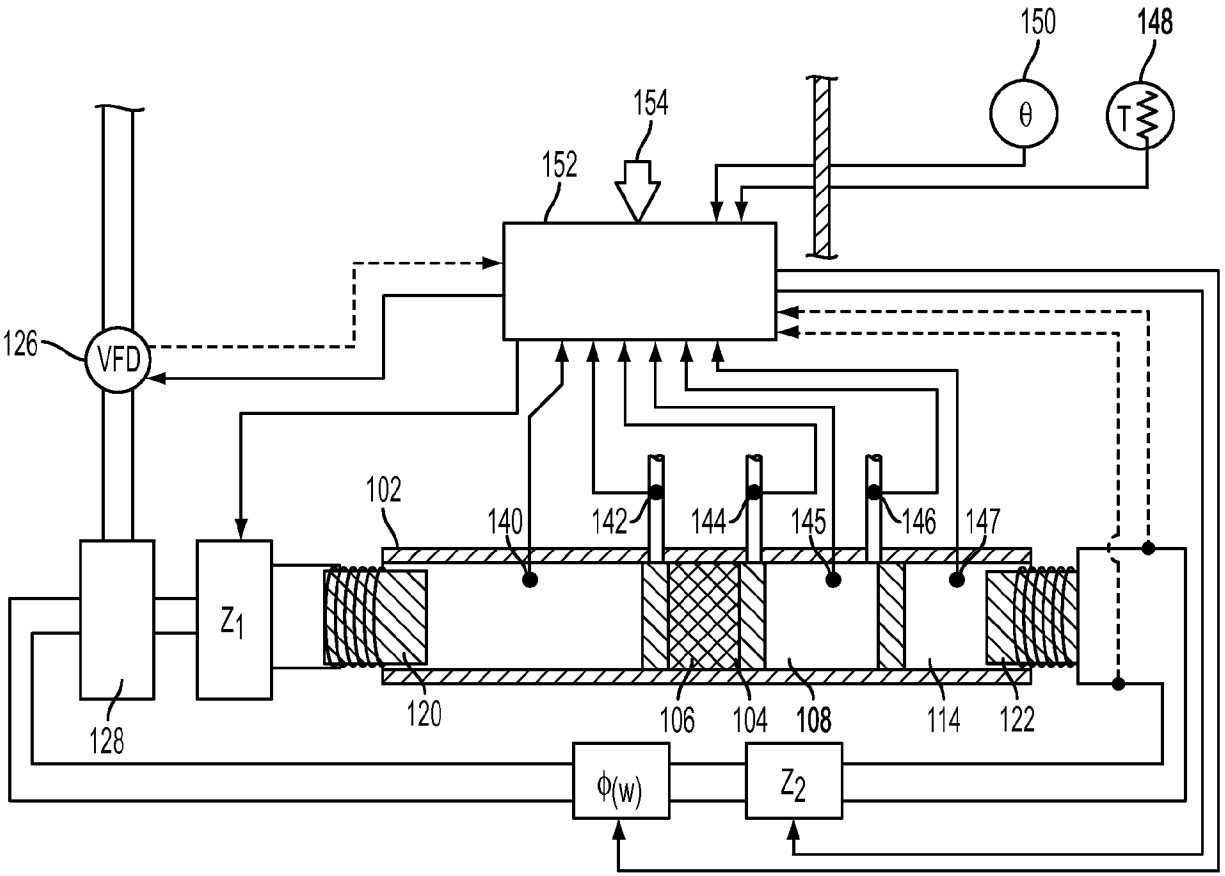
FIG. 2 is a cut-away illustration of a thermoacoustic refrigerator including control circuitry for optimizing efficiency as a function of operating temperatures, ambient temperature and humidity, and selected user input according to a second embodiment of the present disclosure.

FIG. 2 is a cut-away illustration of a second embodiment of a thermoacoustic refrigerator 100 including control circuitry for optimizing efficiency as a function of operating temperatures, the ambient temperature and humidity, and selected user input. Thermoacoustic refrigerator 100 comprises a generally tubular body 102. Disposed within body 102 is regenerator 104.

Adjacent each lateral end of regenerator 104 are first and second heat exchangers 106, 108, respectively. Heat exchangers 106, 108 may be constructed of any of a wide variety of materials and structural arrangements which provide a relatively high efficiency of heat transfer from within body 102 to a transfer medium. In one embodiment, heat exchangers 106, 108 may be one or more tubes for carrying therein a fluid to be heated or cooled. Heat exchangers 106, 108 are formed of a material and sized and positioned to efficiently transfer thermal energy (heating or cooling) between the fluid therein and the gas within body 102 during operation of the refrigerator. To enhance heat transfer, the surface area of heat exchangers 106, 108 may be increased with fins or other structures as is well known in the art. Tubes 110, 112 permit the transfer of fluid from a thermal reservoir or load external to refrigerator 100 to and from heat exchangers 106, 108.

Optionally, a third heat exchanger 114 may be disposed within one end of body 102, for example such that heat exchanger 108 is located between third heat exchanger 114 and regenerator 104. Third heat exchanger 114 may be of a similar construction to first and second heat exchangers 106, 108 such as one or more tubes formed of a material and sized and positioned to efficiently transfer thermal energy (heating or cooling) between a fluid therein and the gas within body 102 during operation of the refrigerator. Tube 116 permits the transfer of fluid from a thermal reservoir or load external to refrigerator 100 to and from the third heat exchanger 114.

An electromechanical driver 120 (for example an acoustic wave source) is disposed at a first longitudinal end of body 102, and an acoustic converter 122 is disposed at a second longitudinal end of body 102 opposite said electromechanical driver 120 relative to said regenerator 104. Many different types of devices may serve the function of electromechanical driver 120, such as well-known moving coil, piezo-electric, electro-static, ribbon or other forms of loudspeaker. A very efficient, compact, frequency tunable, and frequency stable speaker design is preferred so that the cooling efficiency of the refrigerator may be maximized.

Likewise, many different types of devices may serve the function of acoustic converter 122. A well-known electrostatic, electromagnetic, piezo-electric or other form of microphone or pressure transducer may form acoustic converter 122. In addition, gas-spring, compliance elements, inertance elements, or other acoustic elements, may also be employed to enhance the function of converter 122. Again, efficiency is a preferred attribute of acoustic converter 122 so that the cooling efficiency of the refrigerator may be maximized.

A variable frequency driver (VFD) 126 is connected as an input to a combiner 128 (of a type known in the art). VFD 126 is capable of driving electromechanical driver 120 at a desired frequency and amplitude with very high conversion efficiency. Outputs of combiner 128 form inputs to impedance circuit $Z_1$. The outputs of impedance circuit $Z_1$ form the inputs to acoustic source 120. Outputs of a second impedance circuit $Z_2$ are connected as inputs to combiner 128. Outputs from acoustic converter 122 are provided as inputs to the impedance circuit $Z_2$. The role of impedance circuits $Z_1$, $Z_2$, are to match the system impedances so as to drive electromechanical driver 120 efficiently at a desired frequency and phase. A phase delay circuit $\phi(\omega)$ may also be employed to achieve the desired phasing as is well understood in the art.

In operation, oscillating electric power from VFD 126 is provided to electromechanical driver 120, which generates acoustic oscillations in a gas, such as helium, sealed within housing 102. With proper choice of the dimensions and material choices for housing 102 and regenerator 104, and use of an appropriate gas, an approximate Stirling cycle is thus initiated in the region of regenerator 104, establishing a temperature gradient in regenerator 104 such that when the system reaches steady-state, first heat exchanger 106, the "hot" heat exchanger, is at relatively higher temperatures than second heat exchanger 108, the "cold" heat exchanger. Regenerator 104 serves to store heat energy and greatly improve the efficiency of energy conversion.

In order to take into account the various system and ambient temperatures in determining the frequency and/or amplitude at which VFD 126 drives electromechanical driver 120, a number of sensing devices are employed (again, for sensing quantities largely independent of the operating state of the device, such as ambient temperature and humidity, and those that sense quantities that are somewhat or largely dependent on the operating state of the device, such as internal pressure amplitude and gas flow rate and heat exchanger temperatures, and the temperature of the space being cooled). In the embodiment of FIG. 2, the sensors are thermocouples, such as thermocouple 140 for measuring the temperature inside body 102 proximate first heat exchanger 106, thermocouple 142 for measuring the temperature of the heat exchange fluid within heat exchanger 106, thermocouple 144 for measuring the temperature of the heat exchange fluid within heat exchanger 108, thermocouple 145 for measuring the temperature inside body 102 proximate second heat exchanger 108, thermocouple 146 for measuring the temperature of the heat exchange fluid within heat exchanger 114, and thermocouple 147 for measuring the temperature inside body 102 proximate third heat exchanger 114. Again, the use of thermocouples for as temperature sensors is only illustrative; any type temperature sensor may be utilized.

A temperature sensor 148 such as a thermometer or thermocouple is disposed for measuring the ambient temperature in the space to which heat is rejected by the refrigerator. Furthermore, a hygrometer (humidity sensor) 150 may be disposed for measuring the ambient humidity in the space to which heat is rejected by the refrigerator. It should be noted that while various thermocouples, a thermometer, and a hygrometer have been disclosed and shown in FIG. 1, many of these elements are optional, and the minimum embodiment comprises a single thermocouple, thermometer or other sensor. Furthermore, additional thermocouples, thermometers, and other temperature-related sensors such as internal pressure sensors, etc. may be provided, in various combinations, without departing the spirit and scope of the present disclosure.

Each of thermocouples 104, 142, 144, and 146, thermometer 148, and hygrometer 150 (as well as other sensor devices) are connected to provide data to a controller 152. Controller 152 uses the various temperature, humidity, and other measurements to generate a control signal for controlling VFD 126, which controls (varies) the frequency and input power, current, and/or voltage of the electromechanical driver 120 to optimize efficiency or cooling power. Controller 152 may also control the phase ($\phi_{(w)}$) and impedances ($z_1$ and $z_2$)

An additional input to controller 152 may be adjustable user parameters 154. Such user input parameters may include desired cooling power, maximum power consumption, desired cooling temperature, and so on for thermoacoustic refrigerator 100.

According to one embodiment, controller 152 comprises logic that is programmed to vary the frequency and/or power of electromechanical transducer 120 according to a lookup table containing a mapping from ambient temperature to frequency and power. For example, the power can be left fixed and the frequency can be made to increase as the ambient temperature increases. In one embodiment, the lookup table can be implemented with an embedded microprocessor and analog-to-digital and digital-to-analog converters. In another embodiment a fully analog solution consisting of a VFD and combinations of transistor amplifiers and other electronic components can be used. In yet another embodiment, a combination of analog and digital logic can be used.

The optimal frequencies and powers will differ from thermoacoustic device to thermoacoustic device. They will also differ depending on user preferences, such as cooling power. Thus, a user may be provided with control over various inputs 154 to controller 152, for example via a software interface (not shown).

In a feedback embodiment, additional sensors such as pressure and flow velocity sensors (not shown) located within body 102, a measure of the state of VFD 126, and/or a measure of the output of converter 122 are employed.

Figure 3:
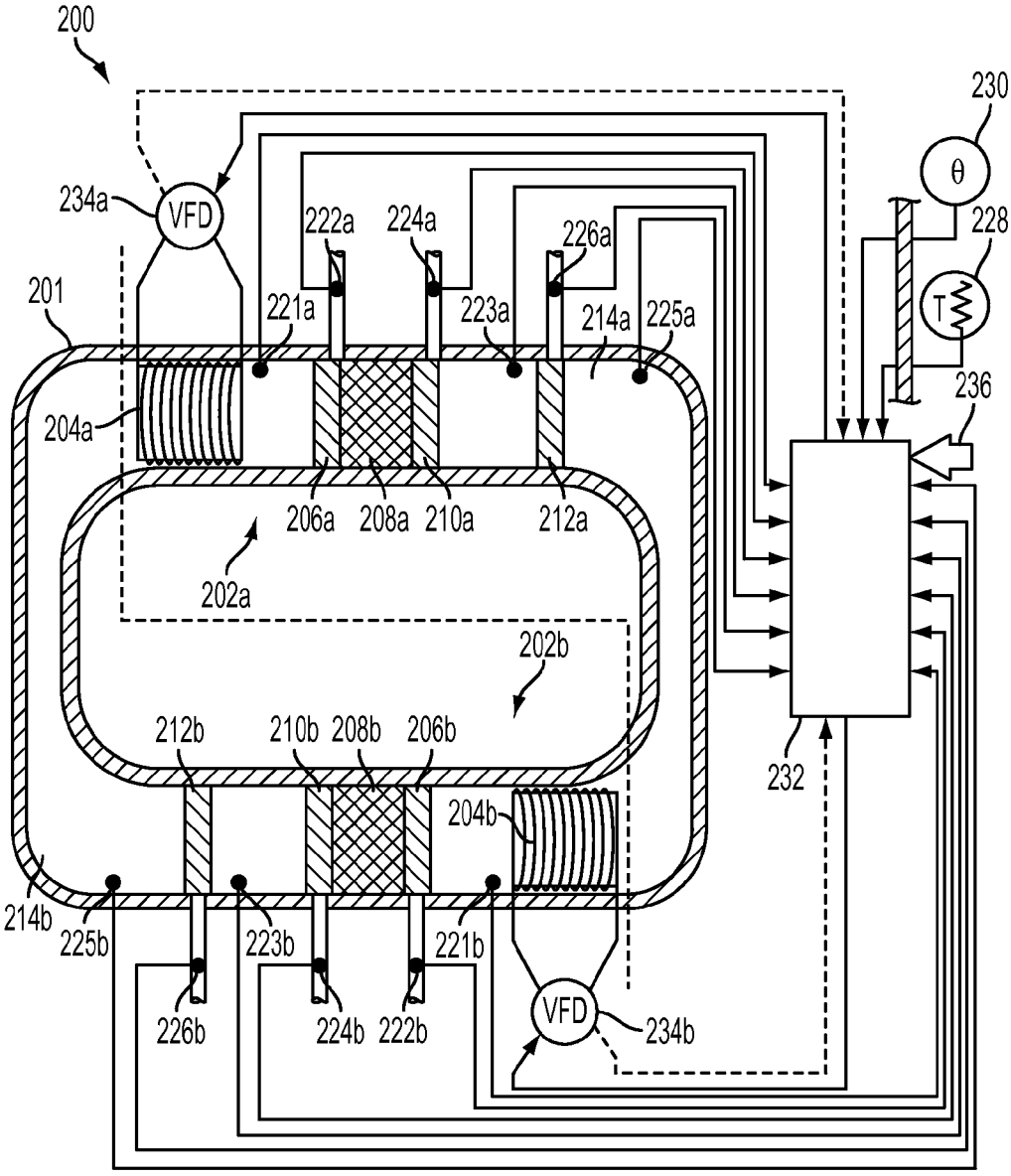
FIG. 3 is a cut-away illustration of a thermoacoustic refrigerator including control circuitry for optimizing efficiency as a function of operating temperatures, ambient temperature and humidity, and selected user input according to a third embodiment of the present disclosure.

It will be appreciated that the arrangement described above can be extended to other configurations of thermoacoustic refrigerators. FIG. 3 illustrates one example of such an alternative. Thermoacoustic refrigerator 200 illustrated in FIG. 3 is a closed loop apparatus with series-connected cooling stages, such as disclosed in the aforementioned U.S. patent application titled "Thermoacoustic Apparatus With Series-Connected Stages", Ser. No. 12/771,617. Briefly, such a system comprises two or more cooling stages 202*a*, 202*b* each including an electromechanical driver 204*a*, 204*b*, first heat exchanger 206*a*, 206*b*, regenerator 208*a*, 208*b*, second heat exchanger 210*a*, 210*b*, and optional third heat exchanger 212*a*, 212*b*, essentially arranged as described above. Each stage 202*a*, 202*b* further comprises an acoustic transmission line 214*a*, 214*b* (which in one embodiment are channels through which an acoustic wave may travel), connected to the back side of the electromechanical driver of the next state in series.

According to the embodiment shown in FIG. 3, thermocouples 222*a*, 224*a*, and 226*a* are provided for measuring the temperatures of the heat exchange fluid within heat exchangers 206*a*, 210*a*, and 212*a*, respectively. Thermocouples 221*a*, 223*a*, and 225*a* are provided for measuring the temperatures proximate heat exchangers 206*a*, 210*a*, and 212*a*, respectively. Similarly, thermocouples 222*b*, 224*b*, and 226*b* are provided for measuring the temperatures of the heat exchange fluid within heat exchangers 206*b*, 210*b*, and 212*b*, respectively. And, thermocouples 221*b*, 223*b*, and 225*b* are provided for measuring the temperatures proximate heat exchangers 206*b*, 210*b*, and 212*b*, respectively.

In addition, a thermometer 228 is disposed for measuring the ambient temperature in the space to which heat is rejected by the refrigerator. Furthermore, a hygrometer (humidity sensor) 230 may be disposed for measuring the ambient humidity in the space to which heat is rejected by the refrigerator. Once again, temperature and humidity checks at various locations have been suggested here, but many are optional, and many different combinations and additional measures are possible and contemplated herein.

Each of the thermocouples, thermometer 228, and hygrometer 230 (as well as other sensor devices) provide data to a controller 232. Controller 232 uses the various temperature, humidity, and other measurements to generate a control signal for controlling VFDs 234*a*, 234*b*, which control (vary) the frequencies, relative phases, and input power, current, and/or voltage provided to electromechanical drivers 204*a*, 204*b*, and/or relative phases of the current and/or voltage of the drivers, to optimize efficiency or cooling power. It should be noted that controller 232 is capable of independently controlling VFDs 234*a*, 234*b*, thereby compensating for differences in the material, dimensions, locations, and other variables between stages 202*a*, 202*b*.

An additional input to controller 232 may be adjustable user parameters 236. Such user input parameters may include desired cooling power, maximum power consumption, desired cooling temperature, and so on for thermoacoustic refrigerator 200.

As described above, in one embodiment controller 232 comprises logic that is programmed (and optionally, reprogrammable) to vary the frequency and/or power and/or current phase of electromechanical transducers 204*a*, 204*b* according to a lookup table containing a mapping from temperatures to frequency, power, and phase for each stage. In another embodiment a fully analog solution consisting of a VFD and combinations of transistor amplifiers and other electronic components for each stage 202*a*, 202*b* can be used. In yet another embodiment, a combination of analog and digital logic can be used.

Additional, optional inputs to controller 232 are feedback from VFDs 234*a*, 234*b*, and data from additional sensors such as pressure and flow velocity sensors (not shown) located within body 201. The feedback loop may be used to further optimize the efficiency and or power use of thermoacoustic refrigerator 200 and provide operational stability as previously discussed.

Figure 4:
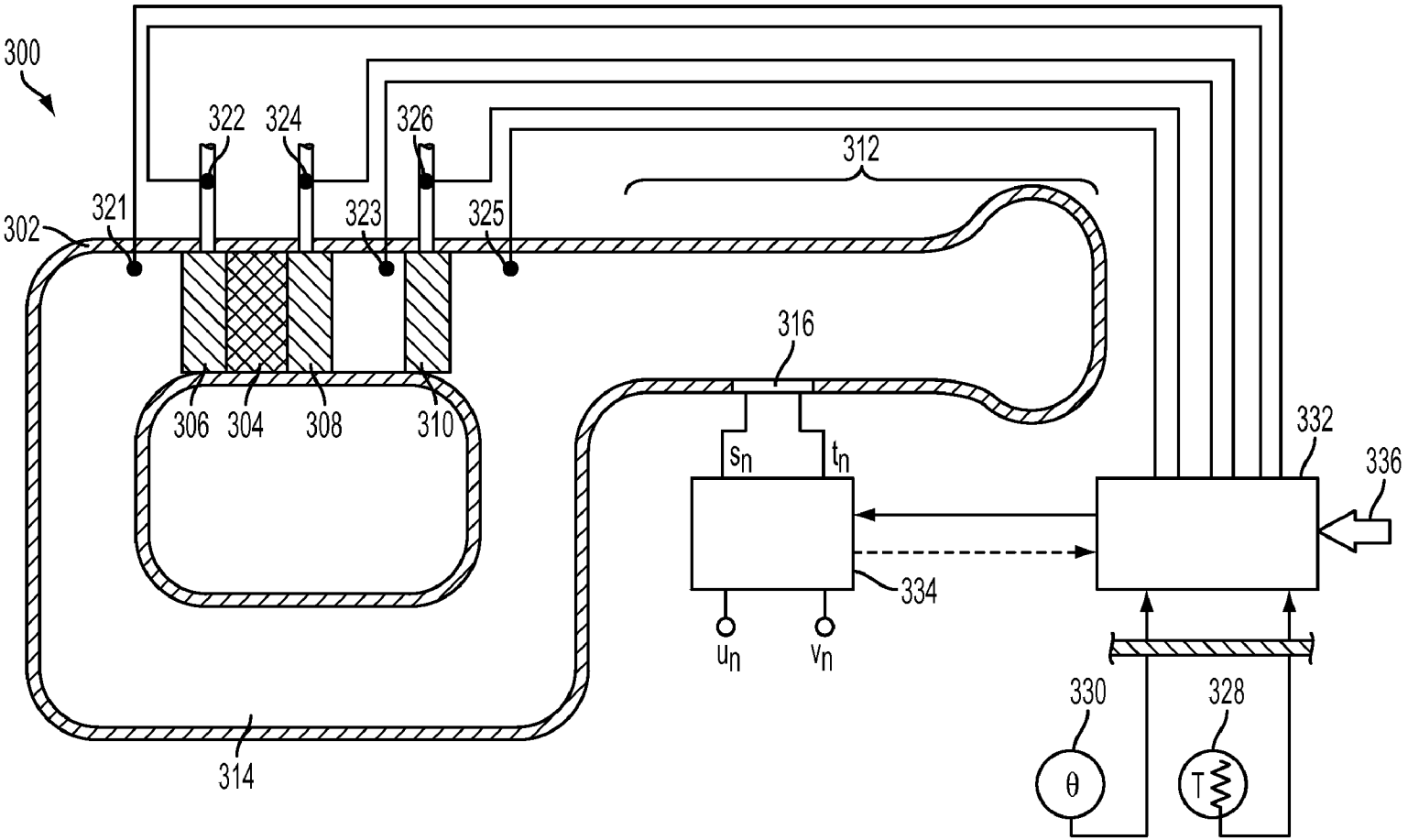
FIG. 4 is a cut-away illustration of a thermoacoustic heat engine including control circuitry for optimizing efficiency as a function of operating temperatures, ambient temperature and humidity, and selected user input according to a first embodiment of the present disclosure.

While the description above has been in terms optimization control for a thermoacoustic refrigerator, the general principles disclosed herein may equally be applied to thermoacoustic heat engines. FIG. 4 is a cross-sectional representation of one embodiment of thermoacoustic heat engine 300 incorporating these general principles. Many elements of thermoacoustic heat engine 300 are well known, but briefly, it comprises a hollow, looped, sealed body structure 302 having a regenerator 304 located therein. The regenerator is proximate first heat exchanger 306, generally a "cold" exchanger, at a first end thereof and a second heat exchanger 308, generally a "hot" exchanger, at the opposite end thereof. A third heat exchanger 310, generally at ambient temperature, may optionally be present. A resonator 312, in the form of an extension of the hollow body structure 302, is provided. Body structure 302 is filled with a pressurized gas. A temperature differential is induced across regenerator 304, i.e., between cold heat exchanger 306 and hot heat exchanger 308, subjecting the gas to localized heat transfer. Acoustic energy in the form of a pressure wave in the region of the regenerator subjects the gas to local periodic compression and expansion. Under favorable acoustic conditions, the gas effectively undergoes an approximate Stirling cycle in regenerator 304.

It is desirable to have a large acoustic impedance at regenerator 304 to reduce fluidic resistance losses. Therefore, one family of known thermoacoustic heat engines use an acoustic resonator and/or an acoustic feedback network 314 to achieve this large impedance. However, such a network is not adjustable in use, and does not take into account operating conditions of the heat engine in order to optimize operation.

Accordingly, the embodiment illustrated in FIG. 4 provided with a variable acoustic impedance, such as an electromechanical transducer 316, which may provide impedance tuning (load) in order to optimize efficiency and operation of thermoacoustic heat engine 300, for example, by modifying the resonant frequency of the device. Essentially, a controllable portion of the energy of the pressure wave within body 302 may be converted to electrical energy by electromechanical transducer 316, depending on various system and ambient temperatures and operating conditions.

In order to take into account the various system and ambient temperatures in determining the operation of electromechanical transducer 316 for frequency and impedance tuning, a number of temperature sensors are employed. According to the embodiment shown in FIG. 4, these sensors take the form of thermocouples, such as thermocouples 322, 324, and 326 for measuring the temperature of the heat exchange fluid within heat exchangers 306, 308, and 310, respectively. Additionally, thermocouples 321, 323, and 325 are provided for measuring the temperatures within body 302 proximate heat exchangers 306, 308, and 310, respectively.

In addition, a thermometer 328 is disposed proximate body 302 for measuring the ambient temperature in the space to which heat is rejected by the heat engine. Furthermore, a hygrometer (humidity sensor) 330 may be disposed proximate body 302 for measuring the ambient humidity in the space to which heat is rejected by the heat engine. Once again, temperature and humidity checks at various locations have been suggested here, but many are optional, and many different combinations and additions are possible and contemplated herein.

Each of thermocouples, thermometer 328, and hygrometer 330 (as well as other sensor devices) are connect to provide data to a controller 332. Controller 232 uses the various temperature, humidity, and other measurements to generate a control signal for controlling a load control circuit 324, described in further detail below, which is connected to electromechanical transducer 316. Load control circuit 324 controls (varies) the load presented by electromechanical transducer 316 and hence tunes the impedance within thermoacoustic heat engine 300 to optimize efficiency of heating.

An additional input to controller 332 may be adjustable user parameters 336. Such user input parameters may include desired heating, efficiency factor, and so on for thermoacoustic heat engine 300.

As described above, in one embodiment controller 332 comprises logic that is programmed (and optionally, reprogrammable) to control load control circuit 334 according to a lookup table containing a mapping from temperatures to load. In another embodiment an analog solution consisting of load control circuit 334 and a combination of transistor amplifiers and other electronic components can be used. In yet another embodiment, a combination of analog and digital logic can be used.

Figure 5:
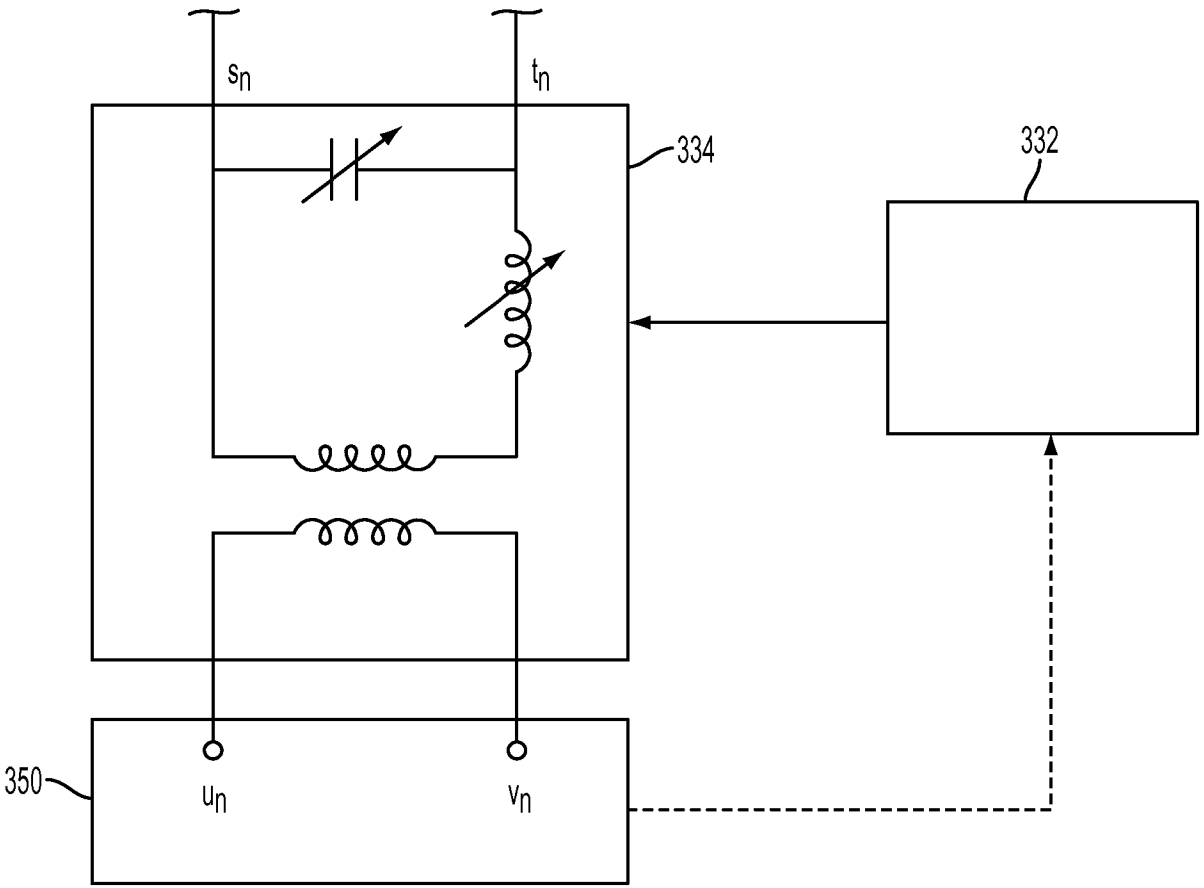
FIG. 5 is a schematic illustration of a load control circuit of a type that may be deployed in a thermoacoustic heat engine of the type illustrated in FIG. 4.

FIG. 5 illustrates one example of a load control circuit 334 of a type that may be employed in the thermoacoustic heat engine 300 of FIG. 4. In the embodiment shown in FIG. 5, a form of variable tap transformer circuit, under control of controller 332, is shown. Many other circuit devices, such as varactor circuits and the like, may also be employed without departing from the spirit and scope of the present disclosure. Electromechanical transducer 316 is connected at $s_n$, $t_n$, to load control circuit 334. At least a portion of the power attenuated by electromechanical transducer 316 is available for use at the output of load control circuit 334 at $u_n$, $v_n$, and a system 350 to which $u_n$, $v_n$ are connected will in part dictate the impedance of electromechanical transducer 316. Thus, in one embodiment a feedback signal is provided from system 350 back to controller 332 in order that controller 332 may provide an optimized control signal to load control circuit 334.

Figure 6:
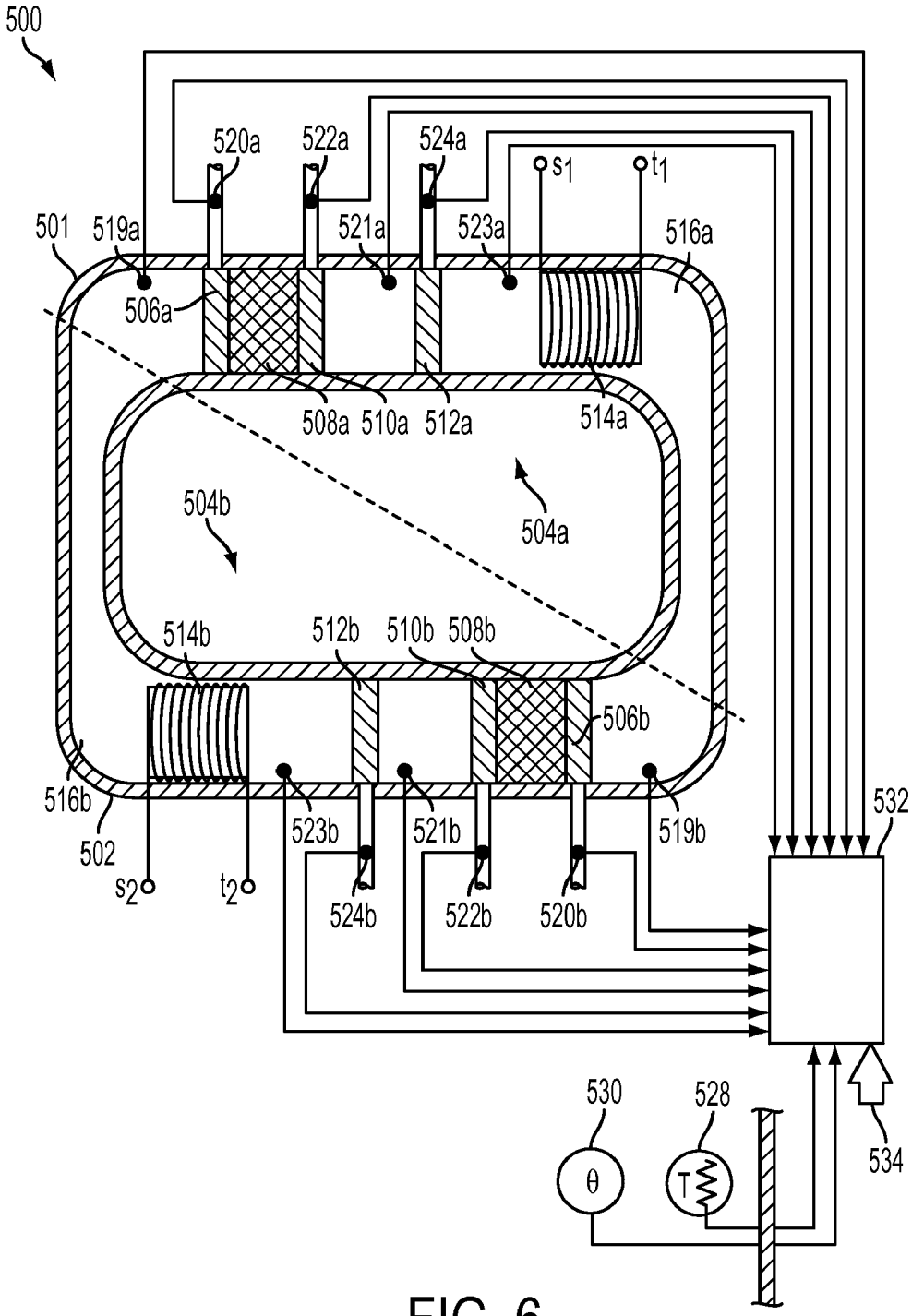
FIG. 6 is a cut-away illustration of a thermoacoustic heat engine including control circuitry for optimizing efficiency as a function of operating temperatures, ambient temperature and humidity, and selected user input according to a second embodiment of the present disclosure.

It will be appreciated that the arrangement described above can be extended to other configurations of thermoacoustic heat engines. FIG. 6 illustrates one example of such an alternative, in this case a two-stage looped heat engine 500, such as disclosed in the aforementioned U.S. patent application titled "Thermoacoustic Apparatus With Series-Connected Stages", Ser. No. 12/771,617. Briefly, such a system comprises a housing 502, divided roughly into two heating stages 504*a*, 504*b* (although more than two stages is within the scope of this disclosure). Disposed in each stage 504*a*, 504*b* are first heat exchangers 506*a*, 506*b*, regenerators 508*a*, 508*b*, second heat exchangers 510*a*, 510*b*, and optional third heat exchangers 512*a*, 512*b*, positioned and operated consistent with the description above. Also disposed within each stage are electromechanical transducers 514*a*, 514*b*. Each stage 504*a*, 504*b* further comprises an acoustic transmission line 516*a*, 516*b* (which in one embodiment are each a channel through which an acoustic wave may travel), connected to the back side of the electromechanical transducer of the next state in series.

According to the embodiment shown in FIG. 6, thermocouples 520*a*, 520*b* for measuring the temperature of the heat exchange fluid within heat exchangers 506*a*, 506*b*, respectively; thermocouples 522*a*, 522*b* for measuring the temperature of the heat exchange fluid within heat exchangers 510*a*, 510*b*, respectively; and optionally, thermocouples 524*a*, 524*b* for measuring the temperature of the heat exchange fluid within heat exchangers 512*a*, 512*b*, respectively. Furthermore, thermocouples 519*a*, 521*a*, and 523*a* are provided for measuring the temperature inside body 501 proximate heat exchangers 506*a*, 510*a*, and 512*a*, respectively. Still further, thermocouples 519*b*, 521*b*, and 523*b* are provided for measuring the temperature inside body 501 proximate heat exchangers 506*b*, 510*b*, and 512*b*, respectively.

Thermometer 528 is disposed proximate thermoacoustic refrigerator 500 for measuring the ambient temperature in the space to which heat is rejected by the heat engine. Furthermore, a hygrometer (humidity sensor) 530 may be disposed proximate thermoacoustic refrigerator 500 for measuring the ambient humidity in the space to which heat is rejected by the heat engine. Once again, temperature and humidity checks at various locations have been suggested here, but many are optional, and many different combinations are possible and contemplated herein. We suggest that the minimum embodiment may comprise thermocouples 518*a*, 518*b*. Additional thermocouples, thermometers, and other temperature-related sensors such as pressure sensors, etc. may be provided, in various combinations, without departing the spirit and scope of the present disclosure.

Each of the thermocouples, thermometer 528, and hygrometer 530 (as well as other sensor devices) are connect to provide data to a controller 532. Controller 532 uses the various temperature, humidity, and other measurements to generate a control signal for controlling load control circuits (not shown) connected to taps s, t of electromechanical transducers 514*a*, 514*b*, respectively. It should be noted that controller 532 is capable of independently controlling each load control circuit for independent load adjustment of electromechanical transducers 514*a*, 514*b*, thereby compensating for differences in the material, dimensions, locations, and other variables between stages 504*a*, 504*b*.

An additional input to controller 532 may be adjustable user parameters 534. Such user input parameters may include desired heat consumption, output power, and so on for thermoacoustic heat engine 500.

As described above, in one embodiment controller 532 comprises logic that is programmed (and optionally, reprogrammable) to control load control circuits for electromechanical transducers 514*a*, 514*b* according to a lookup table containing a mapping from temperatures to load for each stage. In another embodiment an analog solution consisting of load control circuits and a combination of transistor amplifiers and other electronic components can be used. In yet another embodiment, a combination of analog and digital logic can be used.

Figure 7:
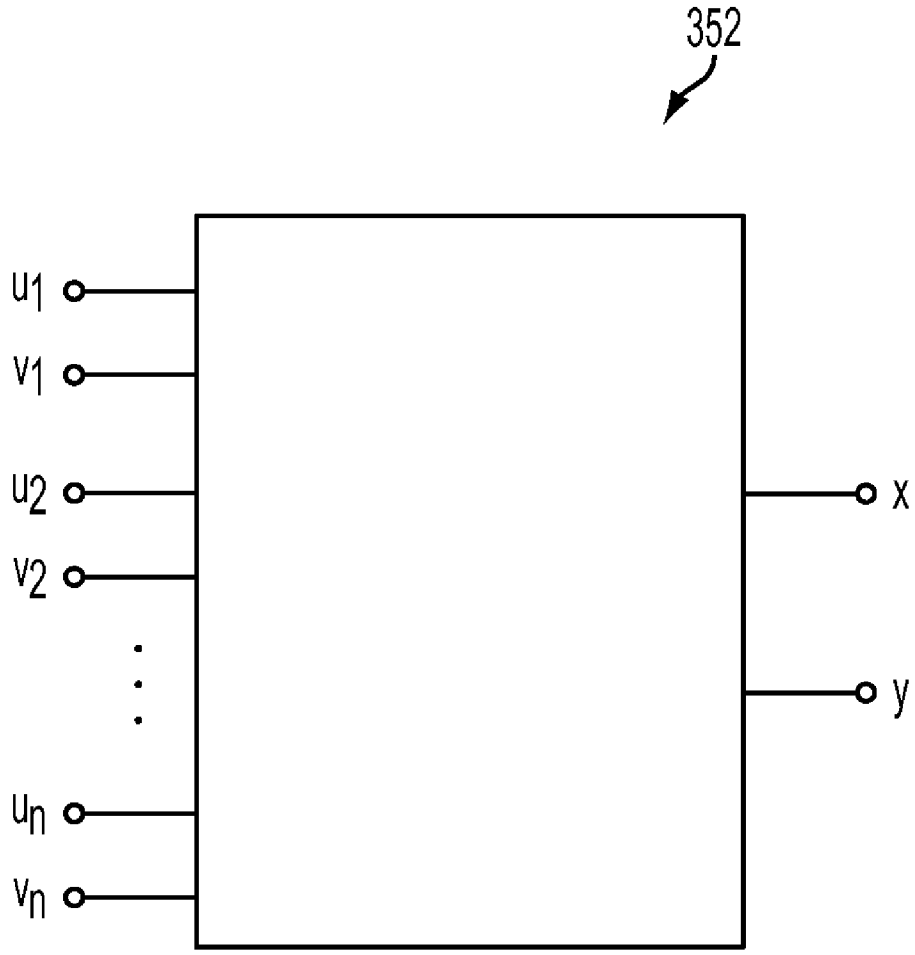
FIG. 7 is a schematic illustration of a power combiner circuit of a type that may be deployed in a thermoacoustic heat engine of the type illustrated in FIG. 4.
Figure 8:
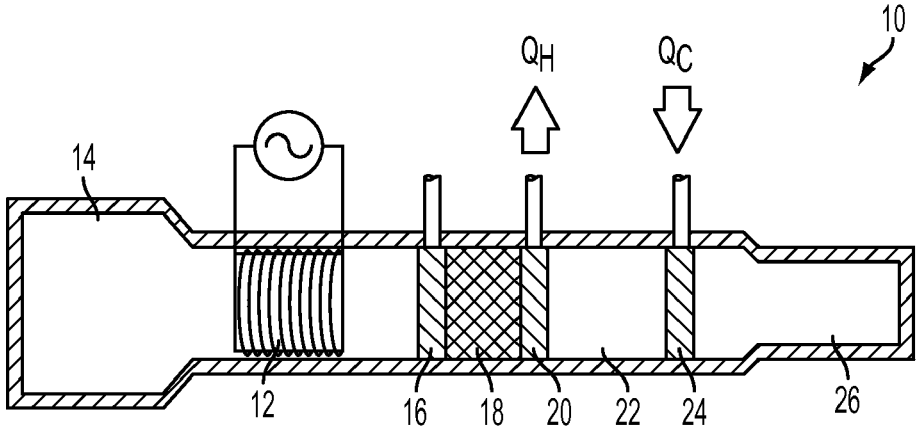
FIG. 8 (PRIOR ART)
FIG. 8 is a cut-away illustration of a first thermoacoustic refrigerator of a type known in the art.
Figure 9:
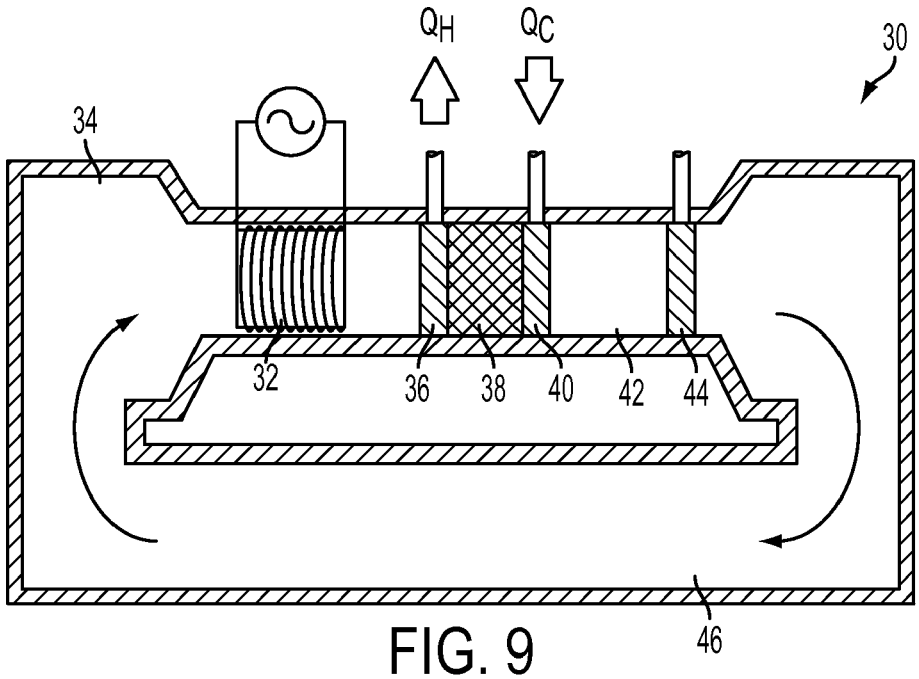
FIG. 9 (PRIOR ART)
FIG. 9 is a cut-away illustration of a second thermoacoustic refrigerator of a type known in the art.
Figure 10:
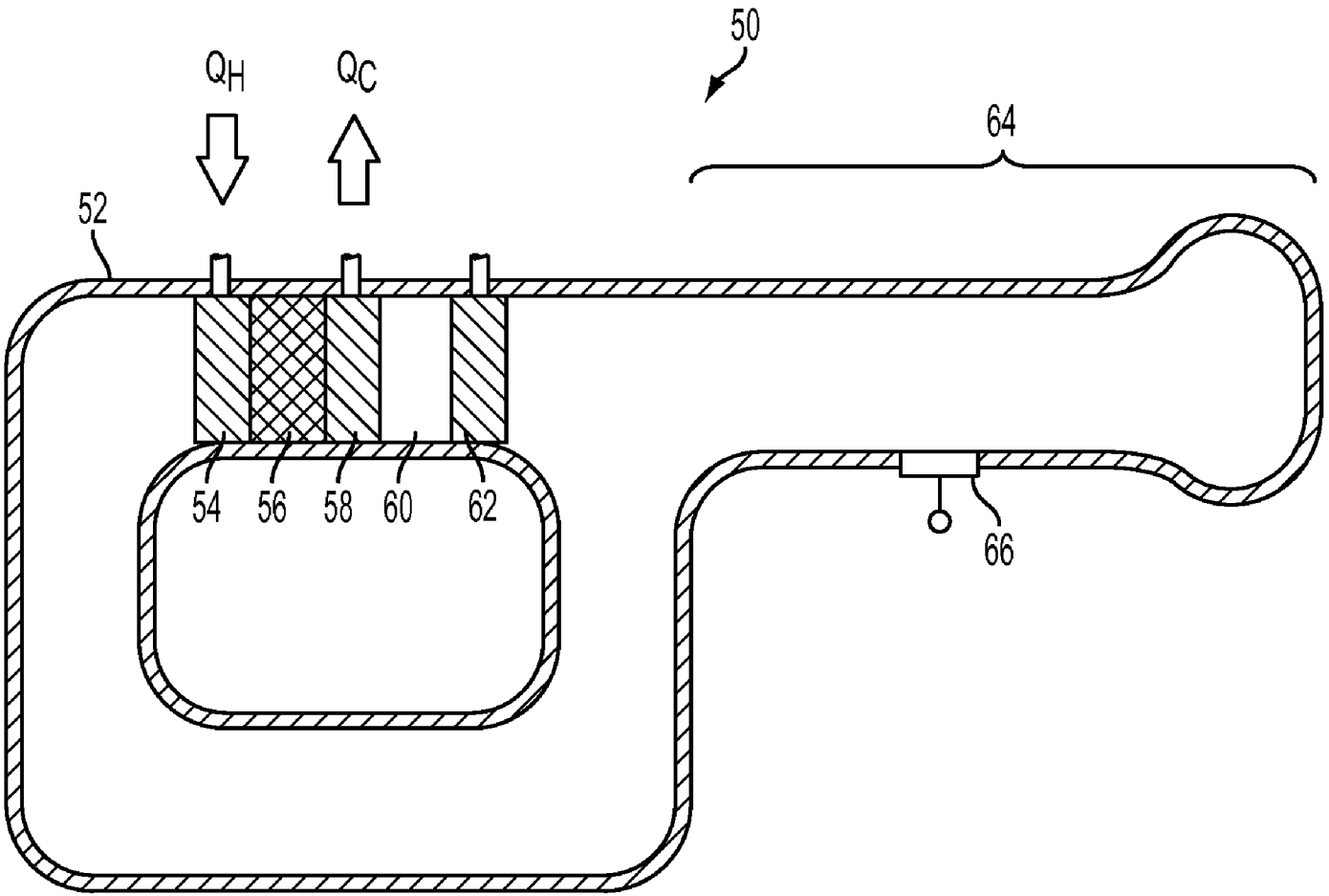
FIG. 10 PRIOR ART
FIG. 10 is a cut-away illustration of a thermoacoustic heat engine of a type known in the art.

Again, at least some power attenuated by electromechanical transducers 514*a*, 514*b* may be used to perform useful work. In the case of an n-stage thermoacoustic heat engine, there may be as many as n electromechanical transducers providing this power. The outputs from these electromechanical transducers may be combined in a combiner circuit 352 shown in FIG. 7 to provide a single output pair x, y for connection to a system (not shown) for performing work. Also as previously discussed, the system to which x and y are connected will in part dictate the frequency and impedance of electromechanical transducers in the n-stage heat engine. Thus, in one embodiment a feedback signal is provided from that system back to a controller (such as controller 532 of FIG. 6) in order that an optimized control signal may be provided to the various load control circuits (such as load control circuit 334 of FIG. 5).

The physics of modern electrical devices and the methods of their production are not absolutes, but rather statistical efforts to produce a desired device and/or result. Even with the utmost of attention being paid to repeatability of processes, the cleanliness of manufacturing facilities, the purity of starting and processing materials, and so forth, variations and imperfections result. Accordingly, no limitation in the description of the present disclosure or its claims can or should be read as absolute. The limitations of the claims are intended to define the boundaries of the present disclosure, up to and including those limitations. To further highlight this, the term "substantially" may occasionally be used herein in association with a claim limitation (although consideration for variations and imperfections is not restricted to only those limitations used with that term). While as difficult to precisely define as the limitations of the present disclosure themselves, we intend that this term be interpreted as "to a large extent", "as nearly as practicable", "within technical limitations", and the like.

Furthermore, while a plurality of preferred exemplary embodiments have been presented in the foregoing detailed description, it should be understood that a vast number of variations exist, and these preferred exemplary embodiments are merely representative examples, and are not intended to limit the scope, applicability or configuration of the disclosure in any way. For example, while thermocouples have been described as devices employed for measuring the temperatures of various parts of the thermoacoustic apparatus during use, other temperature sensors such as thermistors, thermal/infrared imaging sensors, etc. may similarly be employed. In addition to alternatives, various of the above-disclosed and other features and functions, or alternative thereof, may be desirably combined into many other different systems or applications. Various presently unforeseen or unanticipated alternatives, modifications variations, or improvements therein or thereon may be subsequently made by those skilled in the art which are also intended to be encompassed by the claims, below.

Therefore, the foregoing description provides those of ordinary skill in the art with a convenient guide for implementation of the disclosure, and contemplates that various changes in the functions and arrangements of the described embodiments may be made without departing from the spirit and scope of the disclosure defined by the claims thereto.

What is claimed is:

1. A thermoacoustic apparatus, comprising:

a sealed body having a hollow region therein containing a working gas;

a regenerator disposed within said body;

a first heat exchanger, configured for operating at a first temperature, disposed within said body and proximate said regenerator at a first longitudinal end of said body;

a second heat exchanger, configured for operating at a second temperature that is lower than said first temperature, disposed within said body and proximate said regenerator at a second longitudinal end of said body;

an electromechanical driver disposed within said body proximate said first heat exchanger such that acoustic energy from said electromechanical driver is directed into said body;

a temperature sensor for measuring the temperature of said thermoacoustic apparatus, outside of said thermoacoustic apparatus and in an area in which said thermoacoustic apparatus operates, and outside of a load connected to said second heat exchanger, and providing an ambient temperature data signal based on said measured temperature;

a body temperature sensor for measuring temperature within said body proximate, but spaced apart from, at least one of said first or said second heat exchangers and providing a body temperature data signal;

a controller, communicatively connected to said temperature sensor and said body temperature sensor for determining and providing a control signal based on said ambient temperature data signal and said body temperature data signal, said controller generating said control signal at least in part from a plurality of said ambient temperature data signals and said body temperature data signals taken at various times during operation of the thermoacoustic apparatus; and a variable frequency driver communicatively coupled to said electromechanical driver and said controller, for receiving a control signal from said controller, and at least in part as a function of said control signal providing a variable drive signal to said electromechanical driver to thereby provide a selected optimized efficiency of operation for said thermoacoustic apparatus.

2. The thermoacoustic apparatus of claim 1, further comprising:

a first heat exchanger temperature sensor for measuring the temperature of a fluid disposed within said first heat exchanger during operation of said thermoacoustic apparatus and providing a first heat exchanger temperature data signal; and a second heat exchanger temperature sensor for measuring the temperature of a fluid disposed within said second heat exchanger during operation of said thermoacoustic apparatus and providing a second heat exchanger temperature data signal;

said controller further communicatively connected to said first heat exchanger temperature sensor and said second heat exchanger temperature sensor, and wherein said control signal is further determined based on said first and second heat exchanger temperature data signals.

3. The thermoacoustic apparatus of claim 2, wherein said controller is configured to receive user data, and wherein said control signal is further determined based on said user data.

4. The thermoacoustic apparatus of claim 3, wherein said controller comprises memory containing a look-up table in which body temperatures, ambient temperatures, and user data are matched to frequency and drive current, and wherein at a point in time during operation of said thermoacoustic apparatus said control signal includes frequency and drive current values from said table based on corresponding body temperature, ambient temperature, and user data at that point in time.

5. The thermoacoustic apparatus of claim 4, wherein said memory of said controller is reprogrammable.

6. A method of operating a thermoacoustic apparatus of a type which includes a body containing a variable frequency electromechanical driver, a controller, a first heat exchanger configured to operate at a first temperature and a second heat exchanger configured to operate at a second temperature that is lower than said first temperature, and a regenerator, comprising:

determining ambient temperature data of said thermoacoustic apparatus outside of said thermoacoustic apparatus and in an area in which said thermoacoustic apparatus operates, and outside of a load connected to said second heat exchanger during operation of said thermoacoustic apparatus, and providing said ambient temperature data to said controller;

determining body temperature data within said body proximate, but spaced apart from, at least one of said first or said second heat exchangers and providing said body temperature data to said controller;

generating, at said controller, a control signal based on at least said ambient temperature data and said body temperature data taken at various times during operation of the thermoacoustic apparatus, and providing said control signal to a variable frequency driver; and operating said variable frequency driver so as to control the frequency and amplitude of said electromechanical driver based on said control signal such that operation of said electromechanical driver thereby provides a selected optimized efficiency of operation for said thermoacoustic apparatus.

* * * * *